United States Patent [19]

Tupper

[11] Patent Number: 4,584,945

[45] Date of Patent: Apr. 29, 1986

[54] LOAD-TRANSFER DEVICE AND SYSTEM

[75] Inventor: Alan W. Tupper, Castle Combe, England

[73] Assignee: Latchways Limited, London, England

[21] Appl. No.: 573,829

[22] Filed: Jan. 24, 1984

[30] Foreign Application Priority Data

Feb. 2, 1983 [GB] United Kingdom ..... 8302871

[51] Int. Cl.[4] ..... B61B 12/02; B63C 9/00

[52] U.S. Cl. ..... 104/182; 191/76; 441/84

[58] Field of Search ..... 104/182, 112, 115, 116, 104/185, 186, 198, 199; 191/76; 105/151, 153; 182/3; 441/84

[56] References Cited

U.S. PATENT DOCUMENTS

| | | | |
|---|---|---|---|
| 1,122,024 | 12/1914 | O'Connell | 104/182 |
| 1,429,007 | 9/1922 | Wilson | 104/182 |
| 4,265,179 | 5/1981 | Tupper et al. | 104/182 |
| 4,313,236 | 2/1982 | Tupper et al. | 104/182 X |
| 4,352,330 | 10/1982 | Tupper | 104/182 X |
| 4,458,603 | 7/1984 | Voecks | 104/182 |
| 4,459,916 | 7/1984 | Tupper | 104/182 X |
| 4,462,316 | 7/1984 | Tupper | 104/182 X |
| 4,470,354 | 9/1984 | Tupper | 104/182 X |

*Primary Examiner*—Randolph A. Reese
*Assistant Examiner*—David F. Hubbuch
*Attorney, Agent, or Firm*—Scully, Scott, Murphy & Presser

[57] ABSTRACT

A system for securing a life-line around the outside of a structure, e.g., the wheelhouse of a boat, includes attachment devices for the life-line at intermediate positions therealong (particularly at corner parts of the structure) which allow a hook of a safety line attached for sliding movement to the life-line, to pass those attachment points. In one embodiment each attachment device comprises a recessed wheel and a slipper member located to embrace tip portions of the wheel projections to be held thereby while allowing rotation of the wheel relative to the slipper member. In this way the slipper member guides the line in an arcuate path around a peripheral part of the wheelhouse to allow a hook engaged for sliding movement along the life-line to traverse the attachment point by engaging in a recess in the wheel which then rotates relative to the slipper member to pass the hook through the attachment device.

8 Claims, 9 Drawing Figures

FIG. 1.
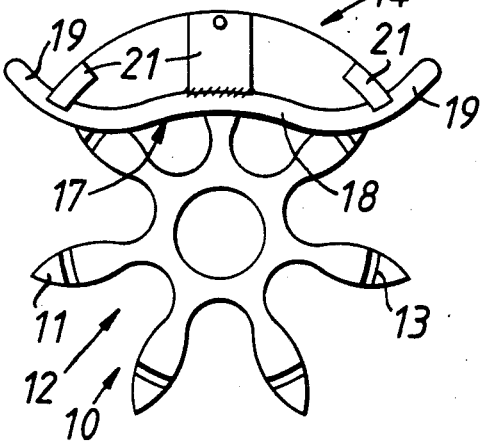
FIG. 2.
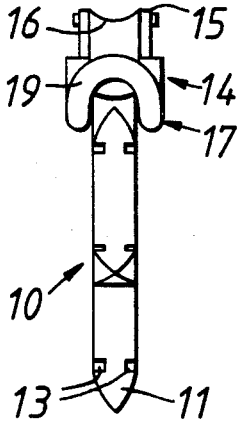
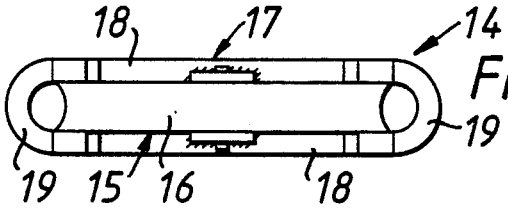
FIG. 3.
FIG. 4.
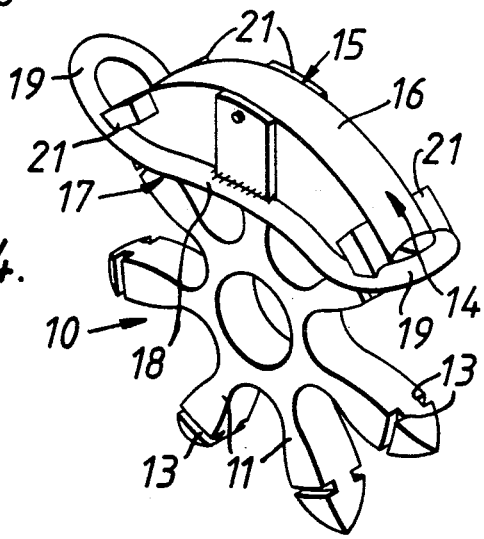

LOAD-TRANSFER DEVICE AND SYSTEM

FIELD OF THE INVENTION

This invention relates to a load-transfer device and system which are adaptations of the type of devices described in British Pat. No. 1,582,201 and systems described in British Pat. No. 2,024,749.

BACKGROUND OF THE INVENTION

In British Pat. No. 2,024,749 there is described safety equipment for boats which comprises a lifeline secured along peripheral portions of the boat, a lanyard which can be hooked onto the life-line and load-transfer devices of the type described in British Pat. No. 1,582,201 providing intermediate attachment points for the life-line while allowing lanyards hooks clipped onto the life-line to traverse each such attachment point.

The present invention is concerned with providing a modified load-transfer device suitable for use in such systems which readily accommodates safety-lines which extend around inboard structures, such as wheel-houses, in which the movement of persons secured thereto is outside the general path defined by the safety line.

SUMMARY OF THE INVENTION

The invention provides a load-transfer device comprising at least one rotatable wheel having a series of recesses at spaced locations around its periphery with adjacent recesses being separated by a projecting part of the wheel and a cooperating slipper part mounted on the wheel at a peripheral part thereof to form an integrated structure with the wheel, the slipper part and the projecting parts of the wheel having arcuate interengaging means adapted to allow rotation of the wheel relative to the slipper part whilst the slipper part remains attached to the wheel; wherein the slipper part has guide means for locating an elongate element, with which the load-transfer device cooperates, in use, with respect to the slipper part along an arcuate path which extends generally along and generally in conformity with a peripheral part of the wheel. Preferably said arcuate path extends outside the periphery of the wheel.

In constructions where a single wheel is provided, said interengaging means may comprise a set of arcuate recesses provided in the projecting portions of the wheel on each side thereof and a corresponding arcuate flange on the slipper part engaging with each set of said recesses.

In some constructions according to the invention, where said arcuate path extends outside the periphery of the wheel, said guide means may comprise an arcuate guide member extending along said arcuate path and having a groove along its outer surface to provide a seating for said elongate member. In such constructions, the guide means may include a part bridging said groove at or adjacent each end thereof so as to retain, in use, an elongate element in said groove. Moreover, in such constructions the slipper member may comprise a pair of arcuate elements for engaging in corresponding arcuate recesses in the projecting parts of the wheel to form therewith said interengaging means, the arcuate elements being connected at their ends by outwardly projecting, generally U-shaped parts which provide said bridging parts located at or adjacent respective ends of said arcuate guide member.

In other constructions according to the invention, where said arcuate path extends outside the periphery of the wheel the slipper part may have portions embracing peripheral portions of said projecting parts of the wheel and may be formed with a generally internal passage extending along said path in which a portion of elongate element is engaged in use. Part of said passage intermediate its length may be exposed outwardly of the slipper part.

The invention also includes a securing system comprising an elongate element secured to a rigid structure at least at one attachment point thereof by a load-transfer device according to the invention with the wheel thereof located rotatably with respect to the rigid structure and with a portion of said elongate element located by said guide means with respect to said slipper part and extending along said arcuate path.

BRIEF DESCRIPTION OF THE DRAWINGS

Embodiments of the invention will now be described by way of example and with reference to the accompanying drawings, in which:

FIG. 1 is a diagrammatic side view of a load-transfer device according to the invention;

FIG. 2 is a diagrammatic end view of the device of FIG. 1;

FIG. 3 is a diagrammatic plan view of the device of FIG. 1;

FIG. 4 is a diagrammatic perspective view of the device of FIG. 1;

DETAILED DESCRIPTION

Figure 5:
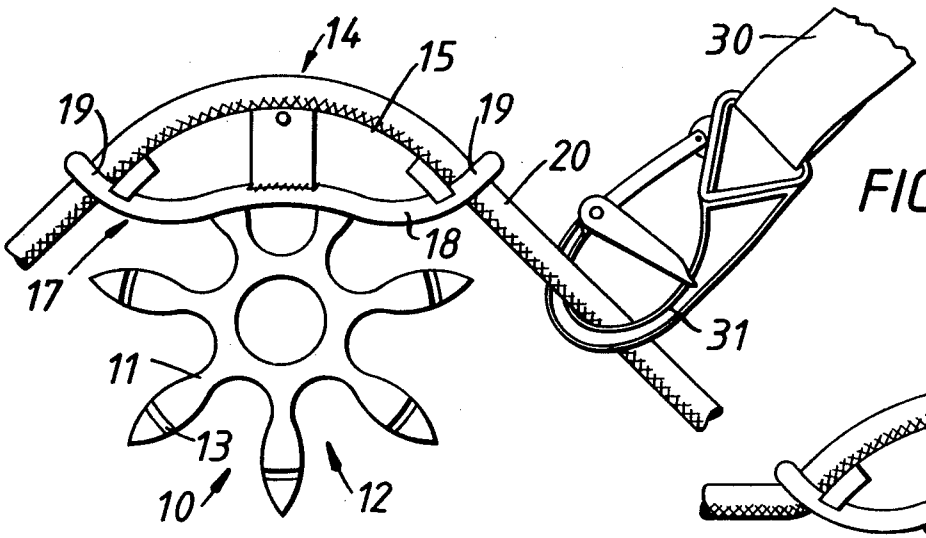
FIGS. 5 to 7 are diagrammatic side views of a life-line attached at intermediate positions by devices as shown in FIGS. 1 to 4.

Referring to FIGS. 1 to 7, a load-transfer device in accordance with the invention comprises a rotary wheel (10) having seven equi-angularly spaced radially projecting parts (11) which define therebetween a series of spaced recesses (12). The projecting parts (11) of the wheel are formed on each side thereof with arcuate grooves (13) which lie on a common circle centered on the axis of rotation of the wheel.

The device also comprises a slipper part (14) which is mounted on a peripheral part of the wheel to form an integrated structure therewith. The slipper (14) comprises an arcuate strip (15) extending around and outwardly of a portion of the circle on which the tip portions of the projecting parts (11) of the wheel lie. The strip (15) is formed with an inwardly projecting groove (16) running from one end thereof to the other in which an elongate element, for example a wire or a rope line, is disposed. The slipper (14) also comprises an endless wire element (17) which is formed with a pair of arcuate side portions (18) which extend one on each side of the wheel and engage in the respective sets of recesses (13) in the projecting parts (11) of the wheel on the opposite sides thereof. Each set of corresponding ends of the arcuate portions (18) of the wire element are connected by integral outwardly projecting, generally U-shaped portions (19), which bridge opposite ends of the grooves (16) in the arcuate member (15) and beneath which the wire or rope (20) extends. These bridging portions (19) provide load-bearing lugs of the slipper.

The wire element (17) and the arcuate strip (15) of the slipper member are united by webs (21) welded to both parts.

A safety line system in accordance with the invention may be installed in boats, although it can be utilized for a wide variety of applications where it is desirable to have a sliding attachment between a lanyard or other attachment line and a fixed safety line, for example for securing persons working high up on building structures. One particular application of a safety line system in accordance with the invention makes use of a safety wire or rope (20) located around a wheelhouse or similar structure on motor boats such as lifeboats or fishing boats. FIG. 5 shows an attachment point for such a safety line (20) at an intermediate location thereof, and where it is required to conform the lifeline and hold it spaced apart from an outwardly projecting corner of the wheelhouse. The wheel of the load-transfer device (10) is rotatably mounted on an arm fixed to the wheelhouse and the safety line (20) is located in the groove in the slipper (14), as described above, by the bridging portions (19) of the wire element (17) of the slipper.

A person can then be secured to the safety line (20) by a lanyard (30) associated with a safety harness that he is wearing; a safety hook (31) at the free end of the lanyard (30) is clipped onto the safety line (20) and can slide along the safety line as required. When it is necessary to traverse the load-transfer device (10) supporting the safety line at a corner of the wheelhouse as shown in FIG. 5, hook (31) engages in a recess (12) in the wheel which on further movement of the lanyard and hook rotates relative to the slipper (14) allowing the hook to pass through the device (10) without becoming detached from the line (20). It will be appreciated that the safety line (20) is held in the required configuration by a load-transfer device according to the invention at a corner of a boat structure such as a wheelhouse where attachment to the safety line is from the outside thereof.

Figure 6:
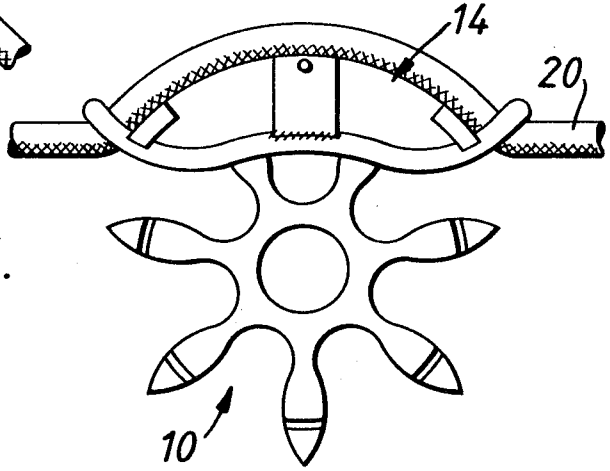
Figure 7:
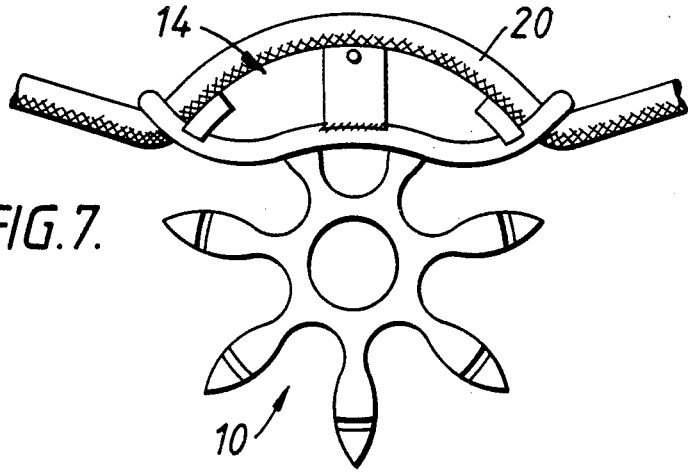

FIG. 6 shows how a load-transfer device according to the invention can also be used for locating the safety line (20) at a position along a straight stretch thereof. FIG. 7 also shows how such a device can be used to locate the safety line at a position where it turns through an obtuse angle.

Figure 8:
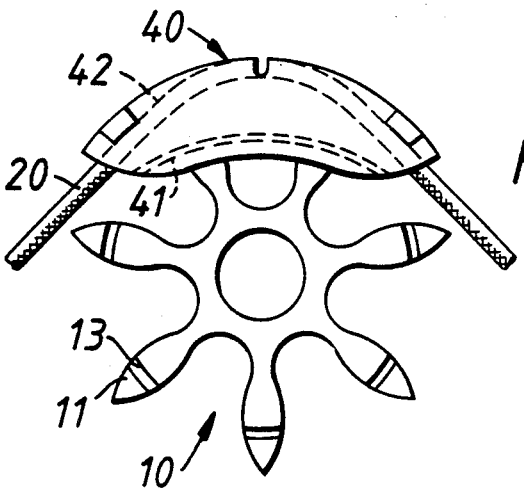
FIG. 8 is a diagrammatic plan view of a second embodiment.

FIG. 8 shows a second embodiment of a load-transfer device in accordance with the invention. The slipper member (40) of this embodiment comprises an arcuate part which embraces tip portions of the projecting parts (11) of the wheel. Arcuate flanges (41) are provided on opposed inner surfaces of side walls of the slipper (40) to engage in the sets of recesses (13) provided in the projecting parts (11) of the wheel. The slipper (40) is formed with an internal passage (42) extending from one thereof to the other through which the safety line (20) extends. It is not necessary for the passage (42) to be contained completely internally of the slipper member (40) and indeed it may be exposed outwardly of the slipper over an intermediate portion of the passage (42).

The slipper (40) may for example be made as a two-part moulding, the parts being screwed, welded or otherwise secured together in position bridging a peripheral portion of the wheel of the load-transfer device.

Figure 9:
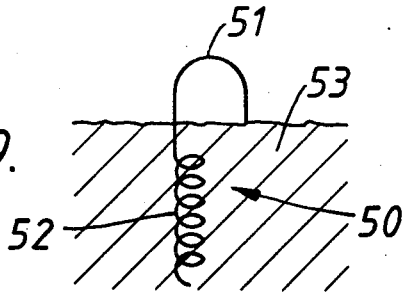
FIG. 9 is a diagrammatic illustration of a possible securing means for a device embodying the invention.

Devices according to the invention can be used in many applications other than marine applications. One such example is illustrated with reference to FIG. 9. The wheel (10) of the load-transfer device is secured with respect to penetrable ground, e.g. a lawn, by a retainer (50), as illustrated in FIG. 9, having an inverted U-shaped head (51) and an integral corkscrew shank 52 for location in the ground (53). The wheel (10) of the load-transfer device is retained by the head (51) of the retainer which passes freely through the central aperture in the wheel allowing the wheel to move unrestrictedly from side to side along the head (51) to take up automatically the correct position for passing a hook in dependence on the direction of the load applied thereto. Such a system could for example be used as a tethering system for an animal or to provide a track for locating other objects, e.g. the flex of a power tool, e.g. a hedge trimmer or lawn mower, to assist in preventing tangling thereof during use or positioning thereof which impedes use of the appliance.

I claim:

1. A load transfer device comprising:

a rotatable wheel including a series of radially extending members forming a series of recesses spaced apart around the periphery of the wheel; and a slipper part mounted on a peripheral part of the wheel to form a connected structure therewith;

the slipper part and the radially extending members of the wheel including arcuate engaging means holding the slipper part connected to the wheel while allowing rotation of the wheel relative to the slipper part;

the slipper including guide means forming a circumferentially extending, outwardly facing groove located radially outside of and curving along the periphery of the wheel to guide an elongated member around the load transfer device.

2. A load transfer device according to claim 1 wherein the engaging means comprises:

a set of arcuate recesses provided in each side of the radially extending members of the wheel; and a pair of corresponding arcuate flanges on the slipper part, each flange engaging a respective set of said recesses.

3. A load transfer device according to claim 2 wherein the guide means includes an arcuate shaped member having an outer surface forming the groove.

4. A load transfer device according to claim 3 wherein the guide means further includes retaining members extending over opposite end portions of the groove to hold the elongated member therein.

5. A load transfer device according to claim 4 wherein the retaining members comprise U-shaped members connected to ends of the arcuate flanges.

6. A load transfer device according to claim 1 wherein the slipper part further includes means forming a generally enclosed passageway circumferentially extending along the groove to receive the elongate member.

7. A load transfer device according to claim 6 wherein the means forming the passageway also form an opening extending radially outward from said passageway, intermediate circumferential ends thereof, to provide access to an intermediate area of the passageway.

8. A securing system comprising:

a rigid structure;

an elongated member;

a load transfer device holding the elongated member attached to the rigid structure, the load transfer device including (i) a rotatable wheel including a series of radially extending members forming a series of recesses spaced apart around the periphery of the wheel, and (ii) a slipper part mounted on a peripheral part of the wheel to form a connected structure therewith, the slipper part and the radially extending members of the wheel including arcuate engaging means holding the slipper part connected to the wheel while allowing rotation of the wheel relative to the slipper part, and the slipper part including guide means forming a circumferentially extending, outwardly facing groove located radially outside of and curving along the periphery of the wheel;

a portion of the elongated member being located in said groove, and said groove guiding the elongated member around the load transfer device; and means connecting the load transfer device to the structure.

* * * * *